US008307812B2

(12) United States Patent
Inoue et al.

(10) Patent No.: US 8,307,812 B2
(45) Date of Patent: Nov. 13, 2012

(54) VAPORIZED-FUEL PROCESSING DEVICE FOR AN ENGINE

(75) Inventors: Hiroshi Inoue, Sakai (JP); Hiroyuki Tsuda, Sakai (JP); Yutaka Teruumi, Sakai (JP); Noriaki Kobayashi, Sakai (JP); Seiji Izuhara, Sakai (JP)

(73) Assignee: Kubota Corporation, Osaka (JP)

( * ) Notice: Subject to any disclaimer, the term of this patent is extended or adjusted under 35 U.S.C. 154(b) by 368 days.

(21) Appl. No.: 12/697,427

(22) Filed: Feb. 1, 2010

(65) Prior Publication Data

US 2010/0199954 A1 Aug. 12, 2010

(30) Foreign Application Priority Data

Feb. 9, 2009 (JP) ..... 2009-027362
Dec. 25, 2009 (JP) ..... 2009-293971

(51) Int. Cl.
*F02M 33/04* (2006.01)
*F02M 33/02* (2006.01)

(52) U.S. Cl. ..... 123/520; 123/572

(58) Field of Classification Search ..... 123/516, 123/517, 518, 519, 520, 521, 572, 574, 585, 123/586, 587, 588, 437, 439
See application file for complete search history.

(56) References Cited

U.S. PATENT DOCUMENTS

| | | | | |
|---|---|---|---|---|
| 3,943,899 | A * | 3/1976 | Matsuoka et al. | 123/585 |
| 5,992,397 | A * | 11/1999 | Hideaki et al. | 123/538 |
| 6,408,835 | B1 * | 6/2002 | Katayama et al. | 123/572 |
| 7,543,573 | B2 * | 6/2009 | Olree | 123/518 |

FOREIGN PATENT DOCUMENTS

| | | |
|---|---|---|
| JP | 07189831 A | 7/1995 |
| JP | 09112355 A | 4/1997 |
| JP | 2009-221918 | 10/2009 |

* cited by examiner

*Primary Examiner* — Mahmoud Gimie
(74) *Attorney, Agent, or Firm* — Panitch Schwarze Belisario & Nadel LLP

(57) ABSTRACT

A vaporized-fuel processing device for an engine stabilizes the idling operation wherein vaporized fuel within a fuel reservoir is adsorbed to an adsorbing member of a canister. While the engine is in operation, air is sucked from an air inlet into the canister with the intake-air negative pressure produced in an intake-air passage. This air separates the vaporized fuel adsorbed to the adsorbing member of the canister. Purge gas resulting from mixing the vaporized fuel into the air is sucked from a purge-gas sucking port into the intake-air passage. A throttle valve is arranged in a throttle intake-air passage of a throttle body. An intake-air pipe is disposed intake-upstream of the throttle body and is communicated with the throttle intake-air passage. The intake-air pipe has a peripheral wall to which a purge-gas sucking pipe is detachably attached. The purge-gas sucking port is provided within the purge-gas sucking pipe.

4 Claims, 7 Drawing Sheets

VAPORIZED-FUEL PROCESSING DEVICE FOR AN ENGINE

TECHNICAL FIELD

The present invention concerns a vaporized-fuel processing device for an engine and more particularly relates to a vaporized-fuel processing device for an engine, able to stabilize the idling operation.

BACKGROUND ART

Conventionally, there was a vaporized-fuel processing device for an engine. In this device, a canister is provided with a vaporized-fuel inlet and with an air inlet as well as with a purge-gas outlet. The vaporized-fuel inlet is communicated with a vaporized-fuel outlet of a fuel reservoir and the air inlet is communicated with the air. Further, the purge-gas outlet is communicated with a purge-gas intake port of an intake-air passage. The vaporized-fuel within the fuel reservoir is adsorbed to an adsorbing member of the canister. While the engine is in operation, air is taken from the air-intake port into the canister with the intake-air negative pressure produced in the intake-air passage. This air separates the vaporized fuel adsorbed to the adsorbing member of the canister and the purge gas resulting from mixing the vaporized-fuel with the air is sucked from a purge-gas sucking port into the intake-air passage (for example, see Patent Literature 1).

The vaporized-fuel processing device for the engine of this type offers an advantage of inhibiting the defect that the vaporized-fuel within the fuel reservoir is sucked into the intake-air passage and is burnt within a combustion chamber to discharge the vaporized fuel into the air.

However, this conventional art arranges the purge-gas intake port intake-downstream of the throttle valve. This causes a problem.

PRIOR ART LITERATURE

Patent Literature

[Patent Literature 1] Patent Application Laid-Open No. 7-189831 (see FIG. 1)

OUTLINE OF THE INVENTION

Problem the Invention Attempts to Solve

<Problem> The idling operation becomes easily unstable.

Since the purge-gas sucking port is arranged intake-downstream of the throttle valve, during the idling operation in which the throttle valve is fully closed or approximately fully closed, a large intake-air negative pressure produced intake-downstream of the throttle valve sucks lots of purge gas from the purge-gas sucking port into the intake-air passage, thereby allowing the purge gas to largely vary the mixing ratio of the air and the fuel with the result of making the idling operation easily unstable.

The present invention has an object to provide a vaporized-fuel processing device for an engine, capable of stabilizing the idling operation.

Means for Solving the Problem

The inventive featuring matters of the invention as defined in claim 1 are as follows.

As exemplified in FIGS. 1(A) and 1(B), FIGS. 4(A) and 4(B) or FIGS. 6(A) and 6(B), in a vaporized-fuel processing device for an engine, a canister 1 is provided with a vaporized-fuel inlet 3 and with an air inlet 2 as well as with a purge-gas outlet 4. The vaporized-fuel inlet 2 is communicated with a vaporized-fuel outlet 6 of a fuel reservoir 5 and the air inlet 3 is communicated with the air. Further, the purge-gas outlet 4 is communicated with a purge-gas sucking port 8 of the intake-air passage 7. The vaporized fuel 9 within the fuel reservoir 5 is adsorbed to an adsorbing member of a canister 1. While the engine is in operation, the air 10 is sucked from the air inlet 3 into the canister 1 with the intake-air negative pressure generated in the intake-air passage 7. This air 10 separates the vaporized fuel 9 adsorbed to the adsorbing member of the canister 1, thereby allowing the purge gas 11 resulting from mixing the air with the vaporized fuel 9 to be sucked from the purge-gas sucking port 8 into the intake-air passage 7. In this vaporized-fuel processing device for the engine, a throttle body 12 is arranged in the intake-air passage 7 and has a throttle intake-air passage 13, which is provided with a throttle valve 14, and an intake-air pipe 15 is arranged intake-upstream of the throttle body 12 and is communicated with a throttle intake-air passage 13, and has a peripheral wall 16 to which a purge-gas sucking pipe 17 is detachably attached, the purge-gas sucking port 8 being arranged within the purge-gas sucking pipe 17.

Effect of the Invention (Invention of Claim 1)

The invention as defined in claim 1 offers the following effect.

<Effect> The idling operation can be stabilized.

As exemplified in FIGS. 1(A) and 1(B), FIGS. 4(A) and 4(B) or FIGS. 6(A) and 6(B), owing to the fact that the purge-gas sucking port 8 is arranged intake-air upstream of the throttle valve 14, during the idling operation in which the throttle valve becomes fully closed, or approximately fully closed, there is not produced such a large intake-air negative pressure on the intake-upstream side of the throttle valve as that generated on its intake-air downstream side and therefore lots of purge gas 11 is not sucked from the purge-gas sucking port 8. This can reduce the variation of the air-fuel mixing ratio so that the idling operation can be stabilized.

<Effect> There is no likelihood that the intake-air property of the throttle body becomes out of control.

As exemplified in FIGS. 1(A) and 1(B), FIGS. 4(A) and 4(B) or FIGS. 6(A) and 6(B), the intake-air pipe 15 is arranged intake-upstream of the throttle body 12 and is communicated with the throttle intake-air passage 13. This intake-air pipe 15 has a peripheral wall 16 to which the purge-gas sucking port 17 is detachably attached. The purge-gas sucking port 8 is provided within the purge-gas sucking pipe 17. In consequence, differently from the case where the purge-gas sucking port 8 is provided in the throttle intake-air passage 13 of the throttle body 12, the throttle body 12 has no probability that its intake property becomes out of control.

<Effect> The existing throttle body without any purge-gas sucking port can be used as it is.

As exemplified in FIGS. 1(A) and 1(B), FIGS. 4(A) and 4(B) or FIGS. 6(A) and 6(B), the intake-air pipe 15 is arranged intake-upstream of the throttle body 12 and is communicated with the throttle intake-air passage 13. This intake-air pipe 15 has the peripheral wall 16 to which the purge-gas sucking port 17 is detachably attached. The purge-gas sucking port 8 is provided within the purge-gas sucking pipe 17. This enables the existing throttle valve 12 without any purge-gas sucking port 8 to be used as it is.

<Effect> This device can be suitably available for the general engine.

As exemplified in FIGS. 1(A) and 1(B), FIGS. 4(A) and 4(B) or FIGS. 6(A) and 6(B), the intake-air pipe 15 has the peripheral wall 16 to which the purge-gas sucking port 17 is detachably attached. The purge-gas sucking port 8 is provided within the purge-gas sucking pipe 17. Therefore, for the general engine that requires to set the amount of the purge gas to be sucked, in correspondence with a size or the like of the fuel reservoir 5, it is sufficient if a plural sorts of purge-gas sucking pipes 17, each of which is provided with a purge-gas sucking port 8 of a different diameter, are prepared and an optimum purge-gas sucking pipe 17 is attached to the intake-air pipe 15 for use. Thus this vaporized-fuel processing device can be employed for the general engine.

(Invention of Claim 2)

In addition to the effect of the invention as defined in claim 1, the invention of claim 2 offers the following effect.

<Effect> The idling operation can be stabilized.

As exemplified in FIGS. 1(A) and 1(B), FIGS. 4(A) and 4(B) or FIGS. 6(A) and 6(B), the intake-air pipe 15 has the peripheral wall 16 to which a blow-by gas sucking pipe 18 is attached, and this blow-by gas sucking pipe 18 is communicated with a breather chamber 19. Owing to this arrangement, during the idling operation in which the throttle valve 14 is fully closed or substantially fully closed, there is not produced such a large intake-air negative pressure on the intake-upstream side of the throttle valve 14 as that generated on its intake-downstream side, which avoids sucking much blow-by gas 20 from the blow-by gas sucking pipe 18. This enables the idling operation to be stabilized.

(Invention of Claim 3)

In addition to the effect of the invention as defined in claim 1, the invention of claim 3 offers the following effect.

<Effect> It is possible to inhibit occurrence of a failure when cold-starting.

As exemplified in FIGS. 1(A) and 1(B), FIGS. 4(A) and 4(B) or FIGS. 6(A) and 6(B), a choke valve 26 is arranged in the throttle intake-air passage 13 of the throttle body 12 upstream of the throttle valve 14. Accordingly, when cold-starting during which the choke valve 26 is fully closed or substantially fully closed, there is not produced such a large intake-air negative pressure on the intake-upstream side of the choke valve 26 as that generated on its intake-downstream side and therefore a large quantity of purge gas 11 and air 10 is not sucked from the purge-gas sucking port 8, thereby reducing the variation of the air-fuel mixing ratio caused by the purge gas 11 and the air 10 and enabling the failure on cold-starting to be inhibited.

(Invention of Claim 4)

In addition to the effect of the invention as defined in claim 2, the invention of claim 4 offers the following effect.

<Effect> It is possible to inhibit the corrosion of the purge-gas sucking pipe.

As exemplified in FIGS. 1(A) and 1(B), FIGS. 4(A) and 4(B) or FIGS. 6(A) and 6(B), the intake-air pipe 15 has a horizontal pipe portion 15*a* an upper peripheral wall 15*b* of which has the purge-gas sucking pipe 17 attached thereto downwardly. Thus even if the condensed water of the moisture within the blow-by gas 20 invades the purge-gas sucking pipe 17, this condensed water flows out of the purge-gas sucking pipe by gravity. For this reason, the purge-gas sucking pipe 17 can be inhibited from being corroded by the sulfuric acid component included in the condensed water.

(Invention of Claim 5)

In addition to the effect of the invention as defined in claim 4, the invention of claim 5 offers the following effect.

<Effect> The total height of the device can be reduced.

As exemplified in FIG. 1(A), FIG. 4(A) or FIG. 6(A), the purge-gas sucking pipe 17 is inclined downwardly. Thus when compared with the case where the purge-gas sucking pipe 17 is made vertically downwards, the height of the purge-gas sucking pipe 17 can be reduced to thereby decrease the total height of the device.

(Invention of Claim 6)

In addition to the effect of the invention as defined in claim 4, the invention of claim 6 offers the following effect.

<Effect> It is possible to inhibit the corrosion of the blow-by gas sucking pipe.

As exemplified in FIG. 1(A), FIG. 4(A) or FIG. 6(A), the intake-air pipe 15 has the horizontal pipe portion 15*a* the upper peripheral wall 15*b* of which has the blow-by gas sucking pipe 18 attached thereto downwardly. Thus even if the moisture in the blow-by gas 20 is condensed, this condensed water flows out of the blow-by gas sucking pipe 18 by gravity. For this reason, the purge-gas sucking pipe 17 can be inhibited from being corroded by the sulfuric acid component included in the condensed water.

(Invention of Claim 7)

In addition to the effect of the invention as defined in claim 6, the invention of claim 7 offers the following effect.

<Effect> It is possible to reduce the total height of the device.

As exemplified in FIG. 1(A), FIG. 4(A) or FIG. 6(A), the blow-by gas sucking pipe 18 has a blow-by gas outlet passage 18*a* inclined downwardly. Thus when compared with the case where the blow-by gas pipe 18 is arranged vertically downwards, the height of the blow-bay gas sucking pipe 18 can be reduced to thereby decrease the total height of the device.

(Invention of Claim 8)

In addition to the effect of the invention as defined in claim 6, the invention of claim 8 offers the following effect.

<Effect> The blow-by gas sucking pipe and the purge-gas sucking pipe can be arranged so that they don't interfere with each other.

As exemplified in FIG. 1(A), FIG. 4(A) or FIG. 6(A), the intake-air pipe 15 has the horizontal pipe portion 15*a* the upper peripheral wall 15*b* of which has the blow-by gas sucking pipe 18 and the purge-gas sucking pipe 17 disposed dividedly in the right and left direction so that they can be arranged not to interfere with each other.

(Invention of Claim 9)

In addition to the effect of the invention as defined in claim 2, the invention of claim 9 offers the following effect.

<Effect> It is possible to inhibit the corrosion of the purge-gas sucking pipe.

As exemplified in FIG. 1(A), FIG. 4(A) or FIG. 6(A), the purge-gas sucking pipe 17 is arranged at a position where it does not come to be intake-downstream of the blow-by gas sucking pipe 18. Thus the condensed water of the moisture in the blow-by gas 20 hardly invades the purge-gas sucking pipe 17. This makes it possible to inhibit the corrosion of the purge-gas sucking pipe 17 by the sulfuric acid component included in the condensed water.

(Invention of Claim 10)

In addition to the effect of the invention as defined in claim 1, the invention of claim 10 offers the following effect.

<Effect> Irrespective of whatever shape the intake-air pipe may have, as regards the stabilization of the idling operation or the like, the same function can be obtained.

As exemplified in FIG. 1(A), FIG. 4(A) or FIG. 6(A), the throttle body 12 has an intake-air inlet portion 12*a* to which an intake-air outlet portion 15*c* of the intake-air pipe 15 is connected and the purge-gas sucking pipe 17 is attached to the intake-air outlet portion 15*c* of the intake-air pipe 15. Then it has been found that even if the intake-air pipe 15 has a different shape, the sucking amount of the purge gas coming from the purge-gas sucking pipe 17 can be made substantially equal. For this reason, independently of whatever shape the intake-air pipe 15 may have, as for the stabilization of the idling operation or the like, the same function can be attained. (Invention of Claim 11)

In addition to the effect of the invention as defined in claim 1, the invention of claim 11 offers the following effect.

<Effect> The idling operation can be stabilized.

As exemplified in FIG. 1(A), FIG. 4(A) or FIG. 6(A), the intake-air pipe 15 has the intake-air outlet portion 15*c* which is formed from a pipe portion of an inner diameter unvariable. Thus when compared with the case where the intake-air pipe 15 has the intake-air outlet portion 15*c* provided with a venturi portion, during the idling operation in which the throttle valve 14 is fully closed or substantially fully closed, there is not produced such a large intake-air negative pressure at the intake-air outlet portion 15*c* and therefore a large quantity of purge gas 11 is not sucked from the purge-gas sucking port 8, thereby reducing the variation of the air-fuel mixing ratio caused by the purge gas 11 and enabling the idling operation to be stabilized.

BRIEF DESCRIPTION OF THE DRAWINGS

FIG. 1 shows a vaporized-fuel processing device for an engine according to a first embodiment. FIG. 1(B) is a sectional view taken along a line B-B in FIG. 1(A).

FIG. 2 shows the intake-air pipe to be used in the device of FIG. 1.

FIG. 3 shows an engine provided with the device of FIG. 1.

FIG. 4 shows a vaporized-fuel processing device for an engine according to a second embodiment.

FIG. 5 shows the intake-air pipe to be used in the device of FIG. 4.

FIG. 6 shows a vaporized-fuel processing device for an engine according to a third embodiment.

FIG. 7 shows the intake-air pipe to be used in the device of FIG. 6.

MOST PREFERRED EMBODIMENT OF THE INVENTION

Figure 2A:
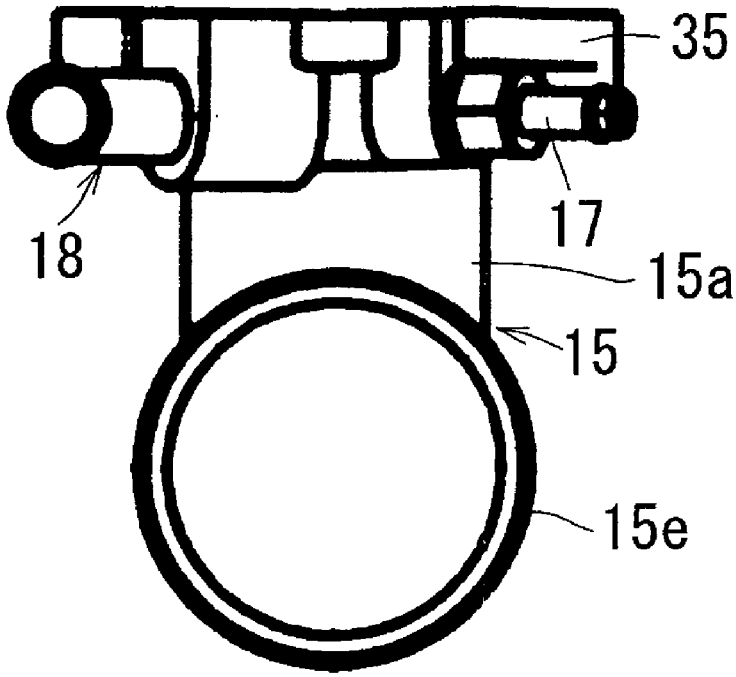
FIG. 2(A) is a plan view and FIG. 2(B) is a front view.
Figure 2B:
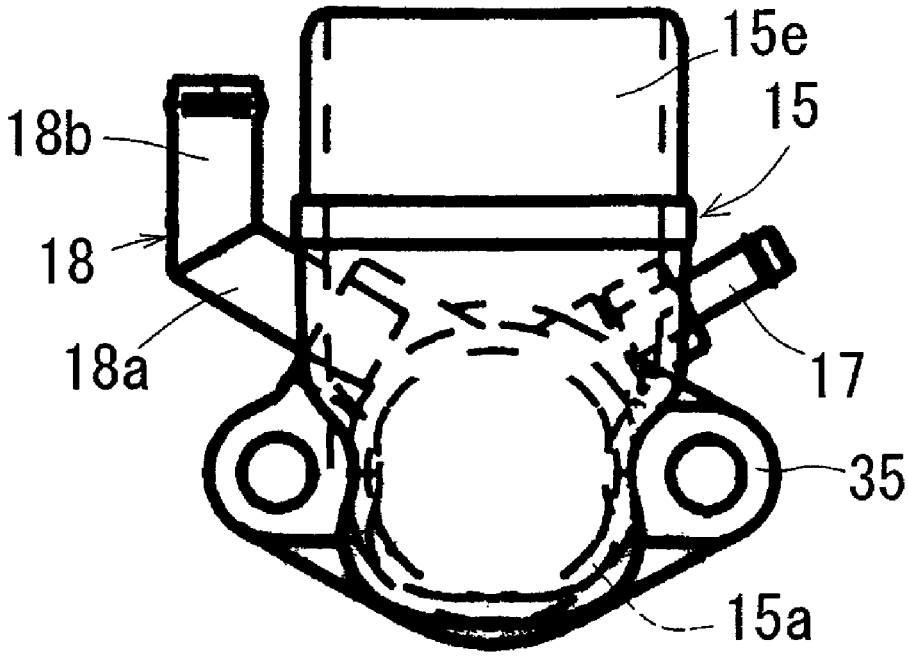
Figure 3A:
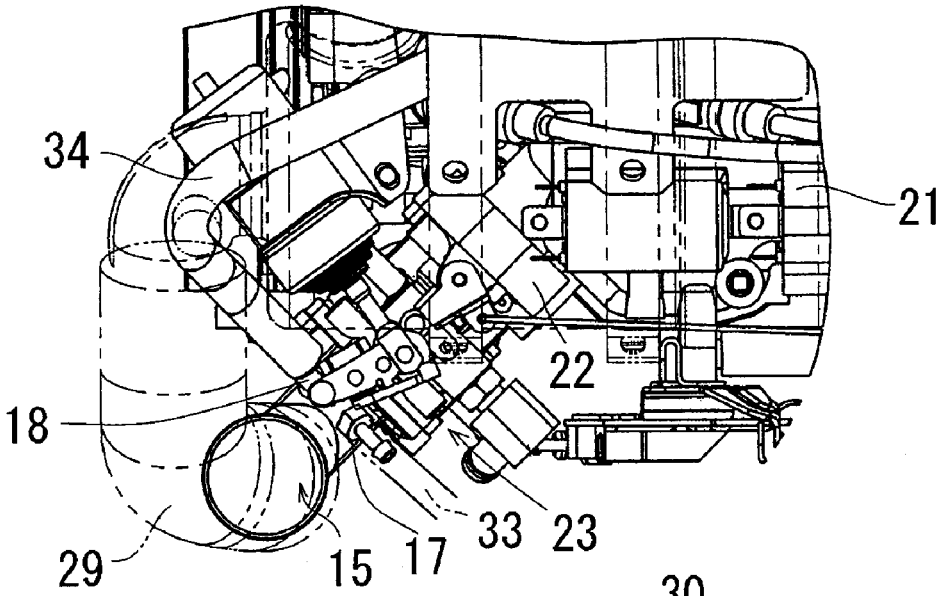
FIG. 3(A) is a plan view of essential portions and FIG. 3(B) is a side elevation view of the essential portions.
Figure 3B:
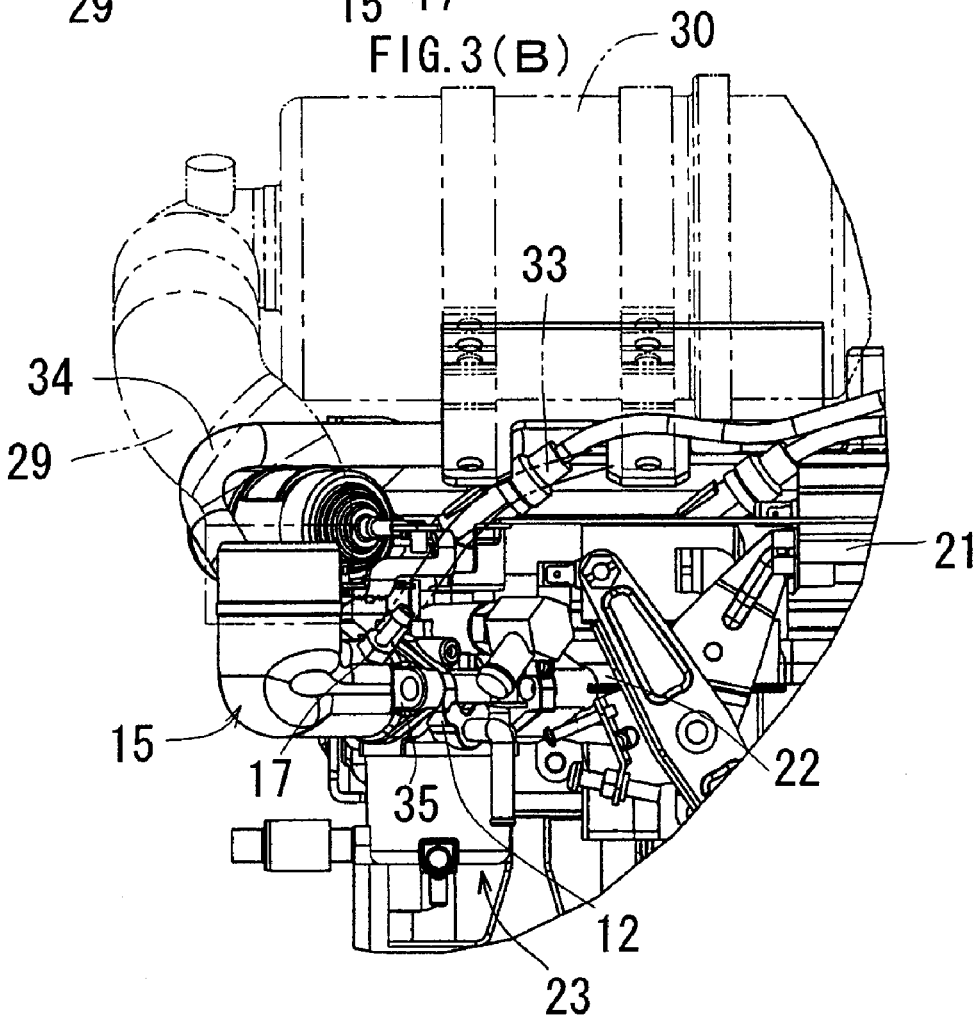

FIGS. 1 to 3 show a vaporized-fuel processing device for an engine according to a first embodiment of the present invention. FIGS. 4 and 5 show another vaporized-fuel processing device for an engine according to a second embodiment of the present invention. FIGS. 6 and 7 show still another vaporized-fuel processing device for an engine according to a third embodiment of the present invention. Each of the embodiments explains a vaporized-fuel processing device for a general vertical multi-cylinder gasoline engine.

First, the first embodiment is explained.

As shown in FIG. 3, a cylinder head has a lateral side to which an intake manifold 21 is attached. This intake manifold 21 has an intake-air inlet 22 to which a throttle body 12 of a carburetor 23 is attached. Attached to this throttle body 12 is an intake-air pipe 15. This throttle body 12, the intake-air pipe 15, a canister 1 and the like constitute a vaporized-fuel processing device.

The vaporized-fuel processing device is outlined as follows.

Figure 1A:
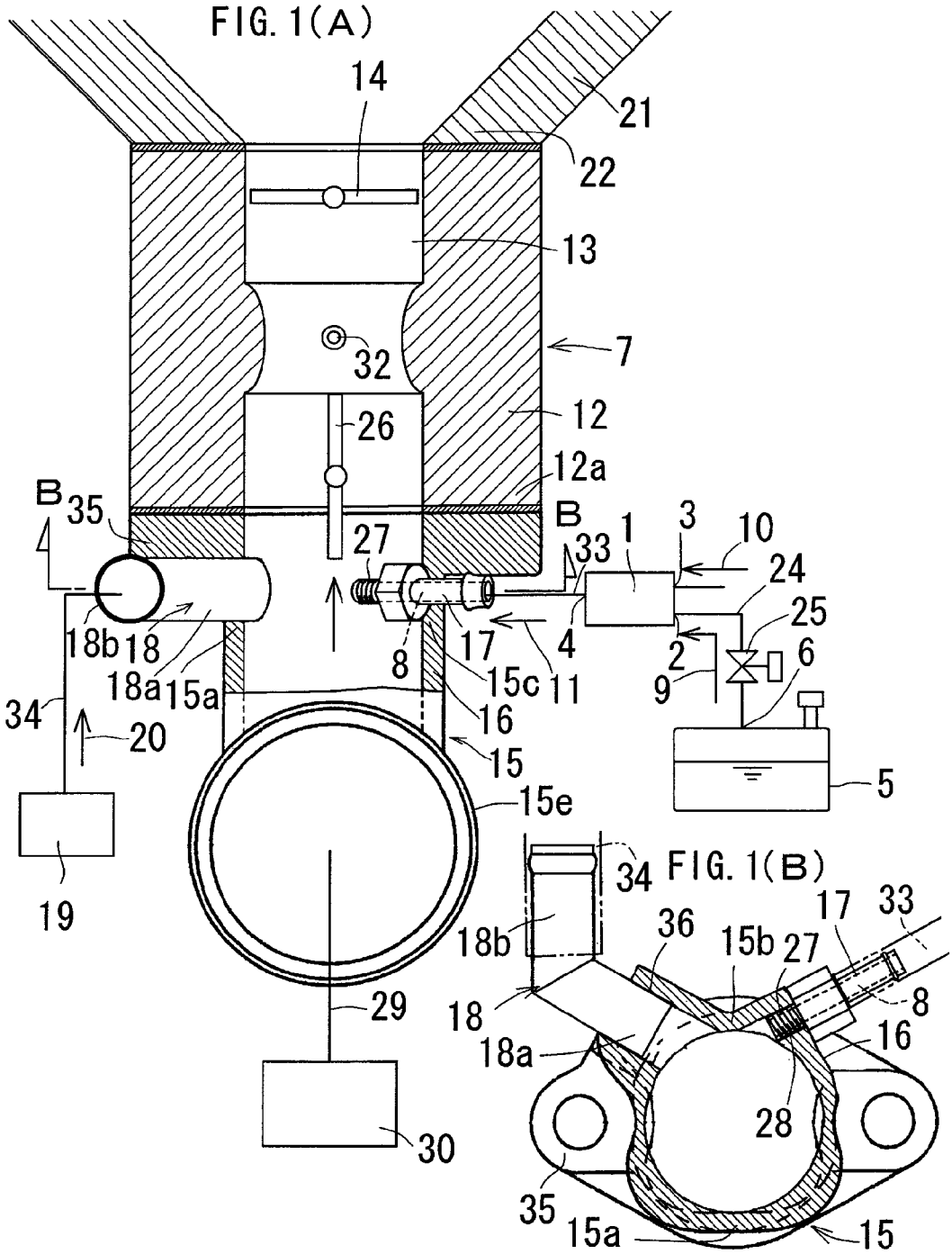
FIG. 1(A) is a plan view, in cross section, of an intake-air pipe and its peripheral parts

As shown in FIG. 1(A), the canister 1 is provided with a vaporized-fuel inlet 2 and with an air inlet 3 as well as with a purge-gas outlet 4. The vaporized-fuel inlet 2 is communicated with a vaporized-fuel outlet 6 of a fuel reservoir 5 and the air inlet 3 is communicated with the air. The purge-gas outlet 4 is communicated with a purge-gas sucking port 8 of an intake-air passage 7. Vaporized fuel 9 within the fuel reservoir 5 is adsorbed to an adsorbing member of the canister 1. While the engine is in operation, the air 10 is sucked from the air inlet 3 into the canister 1 with the intake-air negative pressure produced in the intake-air passage 7. This air 10 separates the vaporized fuel 9 adsorbed to the adsorbing member of the canister 1. Purge-gas 11 resulting from mixing the vaporized-fuel 9 into the air 10 is sucked from the purge-gas sucking port 8 into the intake-air passage 7. Active carbon is used for the adsorbing member of the canister 1.

The canister 1 has the vaporized-fuel inlet 2 communicated with the vaporized-fuel outlet 6 of the fuel reservoir 5 through a vaporized-fuel passage 24. The vaporized-fuel passage 24 is provided with a vaporized-fuel valve 25. The vaporized-fuel valve 25 is closed when the fuel reservoir 5 has an inner pressure below a predetermined value and it is opened if the inner pressure of the fuel reservoir 5 exceeds the predetermined value. Therefore, in the case where the ambient temperature of the fuel reservoir 5 is high and vaporized fuel 9 is produced in a large quantity, the fuel reservoir 5 has its inner pressure increased, thereby allowing the vaporized-fuel valve 25 to open. The vaporized fuel 9 generated in the fuel reservoir 5 flows into the canister 1 through the vaporized-fuel passage 24 to be adsorbed by the adsorbing member. Then if the ambient temperature of the fuel reservoir 5 is decreased and the vaporized fuel is produced in less amount, the fuel reservoir 5 has its inner pressure reduced and the vaporized-fuel valve 25 is closed.

A concretely explanation is as follows.

While the engine is in operation, in the event that the ambient temperature of the fuel reservoir 5 is high and the vaporized fuel 9 is produced in a large quantity, the vaporized-fuel valve 25 is opened and the vaporized fuel 9 is adsorbed to the adsorbing member of the canister 1. At the same time, the intake-air negative pressure generated in the intake-air passage 7 sucks the air 10 from the air inlet 3 into the canister 1. The air 10 separates the vaporized fuel 9 adsorbed to the adsorbing member of the canister 1 and the purge gas resulting from mixing the vaporized fuel 9 into the air 10 is sucked from the purge-gas sucking port 8 into the intake-air passage 7.

While the engine is in operation, if the reduction of the engine's exothermic amount attributable to the decrease of the engine's load or the cooling around the fuel reservoir 5 lowers the ambient temperature of the fuel reservoir 5 and decreases the production amount of the vaporized fuel 9, the vaporized-fuel valve 25 is closed to stop adsorbing the vaporized fuel 9 to the adsorbing member of the canister 1. The vaporized fuel 9 adsorbed to the adsorbing member of the canister 1 is separated by the air 10 sucked from the air inlet 3 and the purge gas resulting from mixing the vaporized-fuel 9 into the air 10 is sucked from the purge-gas port 8 into the intake-air passage 7.

In summer, even if the engine is stopping, the ambient temperature of the fuel reservoir 5 is high and the vaporized fuel 9 is generated in a large quantity. Consequently, the vaporized-fuel valve 25 is opened and the vaporized fuel 9 is adsorbed to the adsorbing member of the canister 1. And during the engine's operation, due to the cooling around the fuel reservoir 5 or the like, the ambient temperature of the fuel reservoir 5 is decreased to thereby reduce the production amount of the vaporized fuel 9. Then the vaporized-fuel valve 25 is closed to stop adsorbing the vaporized fuel 9 to the adsorbing member of the canister 1. The air 10 sucked from the air inlet 3 into the canister 1 separates the vaporized fuel 9 adsorbed to the adsorbing member of the canister 1 and the purge gas resulting from mixing the vaporized-fuel 9 into the air 10 is sucked from the purge-gas sucking port 8 into the intake-air passage 7.

The vaporized-fuel processing device is devised as follows.

As shown in FIG. 1(A), a throttle body 12 is arranged in the intake-air passage 7 and has a throttle intake-air passage 13, which is provided with a throttle valve 14.

As illustrated in FIGS. 1(A) and 1(B), an intake-air pipe 15 is arranged an intake-upstream of the throttle body 12 and is communicated with the throttle intake-air passage 13. The intake-air pipe 15 has a peripheral wall 16 to which a purge-gas sucking pipe 17 is detachably attached. The purge-gas sucking port 8 is provided within the purge-gas sucking pipe 17.

As shown in FIG. 1(A), the purge-gas pipe 17 has a leading end an outer peripheral surface of which is provided with an externally threaded portion 27. As shown in FIG. 1(B), the externally threaded portion 27 is engaged with an internally threaded portion 28 provided in a peripheral surface of the intake-air pipe 15 in screw-thread fitting relationship. The purge-gas sucking pipe 17 has a base end portion engaged with a leading end portion of a pipe 33 for communication with the canister 1 in fitting relationship. The purge-gas sucking pipe 17 has the base end portion connected to the purge-gas outlet 4 of the canister 1 and has the purge-gas sucking port 8 communicated with the purge-gas outlet 4 through the canister-communication pipe 33.

As shown in FIGS. 2(A) and 2(B), the intake-air pipe 15 is an elbow pipe which comprises a horizontal pipe portion 15*a* on its base end side and a vertical pipe portion 15*e* on its leading end side. The base end portion is provided with a flange 35 through which the throttle body 12 is assembled as shown in FIG. 1(A). The intake-air pipe 15 has its leading end portion engaged with a pipe 29 for communication with an air cleaner 30 in fitting relationship. The air-cleaner communication pipe 29 has a base end connected to the air cleaner 30. The intake-air pipe 15 has an inner passage communicated with the downstream throttle intake-air passage 13 and with the air cleaner 30 through the upstream air-cleaner communication pipe 29.

As shown in FIG. 1(A), while the engine is in operation, in order that the intake-air negative pressure produced in the intake-air passage 7 can suck blow-by gas 20 from a breather chamber 19 into the intake-air pipe 15, the intake-air pipe 15 has the peripheral wall 16 to which a blow-by gas sucking pipe 18 is attached and is communicated with the breather chamber 19.

As shown in FIG. 1(B), the blow-by gas sucking pipe 18 has on its base end side a blow-by gas outlet passage 18*a* that is fitted into an attaching hole 36 in the peripheral wall of the intake-air pipe 15 and has on its leading end side a blow-by gas inlet passage 18*b* onto which a pipe 34 for communication with the breather chamber 19 has its leading end externally fitted. The breather-chamber communication pipe 34 has a base end portion connected to the breather chamber 19 and the blow-by gas sucking pipe 18 is communicated with the breather chamber 19 through the breather-chamber communication pipe 34.

Communicated with a crank case (not shown) is the breather chamber 19 into which the blow-by gas 20 leaked from the cylinder (not shown) is flowed.

As shown in FIG. 1(A), a choke valve 26 is provided upstream of the throttle valve 14 in the throttle intake-air passage 13 of the throttle body 12. A venturi pipe 31 is arranged between the choke valve 26 and the throttle valve 14 and is made to open a fuel outlet of a main nozzle 32.

In this vaporized-fuel processing device, the purge-gas sucking port 8 and the blow-by gas sucking pipe are arranged upstream of the choke valve 26. Thus upon cold starting in which the choke valve 26 is fully closed or approximately fully closed, there is not produced such a large negative pressure on the intake-upstream side of the choke valve 26 as that generated on its intake-downstream side and therefore a large quantity of purge gas 11, air 10 and blow-by gas 20 is not sucked from the purge-gas sucking port 8 and the blow-by gas sucking pipe 18, thereby allowing the purge gas 11 and the blow-by gas 20 to only slightly vary the air and fuel mixing ratio and enabling the failure on cold starting to be inhibited.

The other devises are as follows.

As shown in FIG. 1(A), the intake-air pipe 15 has the horizontal pipe portion 15*a* to the upper peripheral wall 15*b* of which the purge-gas sucking pipe 17 is attached in downward inclination.

The intake-air pipe 15 has the horizontal pipe portion 15*a* to the upper peripheral wall 15*b* of which the blow-by gas sucking pipe 18 has a blow-by gas outlet passage 18*a* attached in downward inclination. The blow-by gas sucking pipe 18 has a blow-by gas inlet passage 18*b* arranged vertically downwards.

The intake-air pipe 15 has the horizontal pipe portion 15*a* the upper peripheral wall 15*b* of which has the blow-by gas sucking pipe 18 and the purge-gas sucking pipe 17 arranged dividedly in the left and right direction.

When the horizontal pipe portion 15*a* of the intake-air pipe 15 is seen from just above, where its width direction is a lateral direction, the purge-gas sucking pipe 17 is arranged at a position immediately lateral of the blow-by gas sucking pipe 18. The purge-gas sucking pipe 17 may be disposed intake-upstream of the blow-by gas sucking pipe 18.

More specifically, the purge-gas sucking pipe 17 is arranged so that it does not position intake-downstream of the blow-by gas sucking pipe 18.

The throttle body 12 has a intake-air inlet portion 12*a* connected to the intake-air outlet portion 15*c* of the intake-air pipe 15, to which the purge-gas sucking pipe 17 and the blow-by gas sucking pipe 18 are attached. If they are arranged as such, it has been found that even though the intake-air pipe 15 has a different shape, the amount of the purge gas 11 to be sucked from the purge-gas sucking pipe 17 can be made substantially equal to the amount of the blow-by gas 20 to be sucked from the blow-by gas pipe 18. For this reason, irrespective of whatever shape the intake-air pipe 15 may have, as regards the stabilization of the idling operation or the like, the same function can be obtained.

The intake-air pipe 15 has the intake-air outlet portion 15*c* which is formed from a pipe portion of an inner diameter unvariable.

Figure 4A:
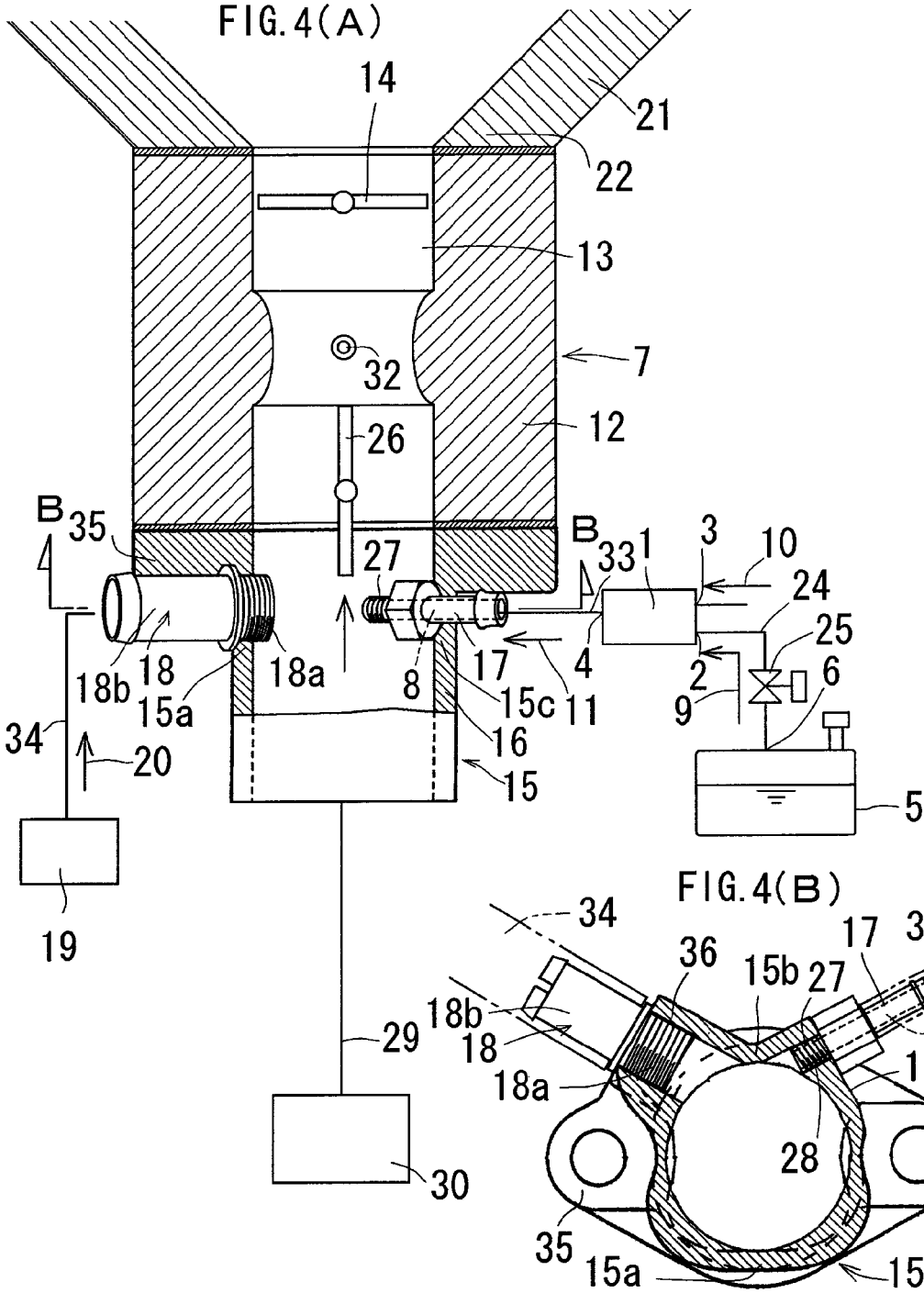
FIG. 4(A) is a plan view, in cross section, of an intake-air pipe and its peripheral parts
Figure 4B:
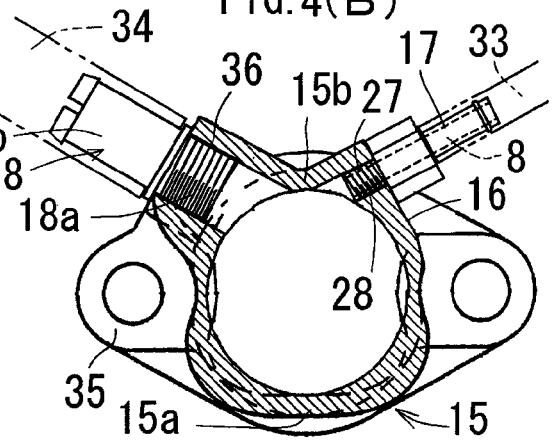
FIG. 4(B) is a sectional view taken along a line B-B in FIG. 4(A).
Figure 5A:
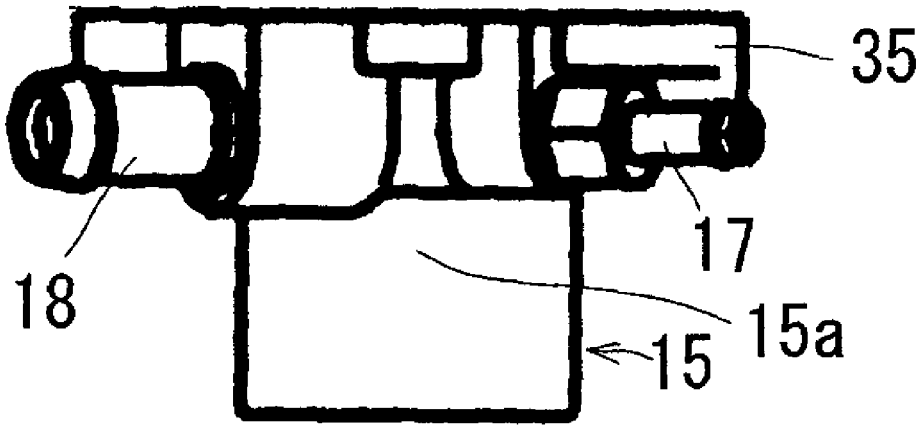
FIG. 5(A) is a plan view and FIG. 5(B) is a front view.
Figure 5B:
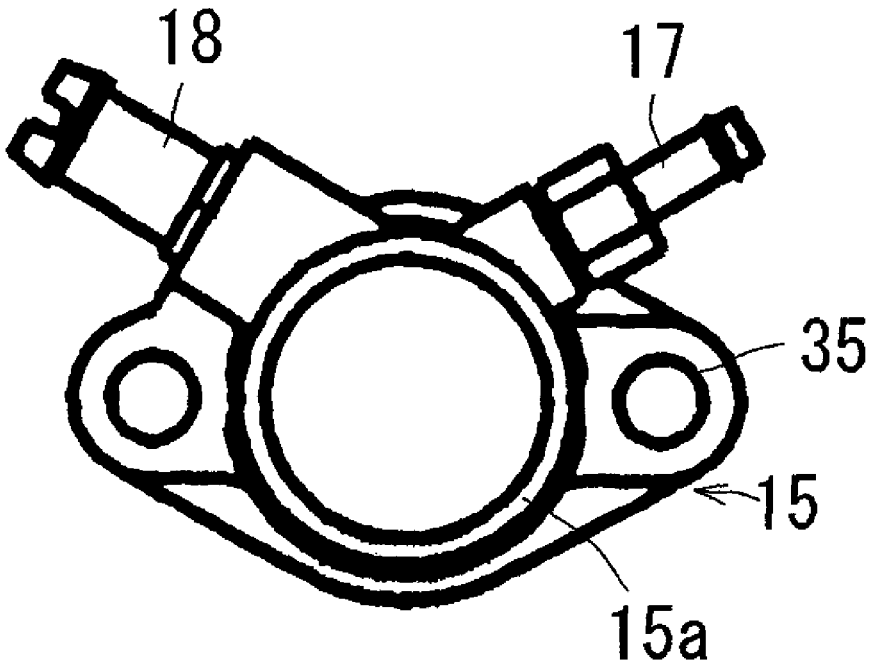

In the second embodiment as shown in FIGS. 4(A) and 4(B) as well as in FIGS. 5(A) and 5(B), the intake-air pipe 15 is a straight pipe and has a horizontal pipe portion 15*a* a base end portion of which is provided with a flange 35.

Figure 6A:
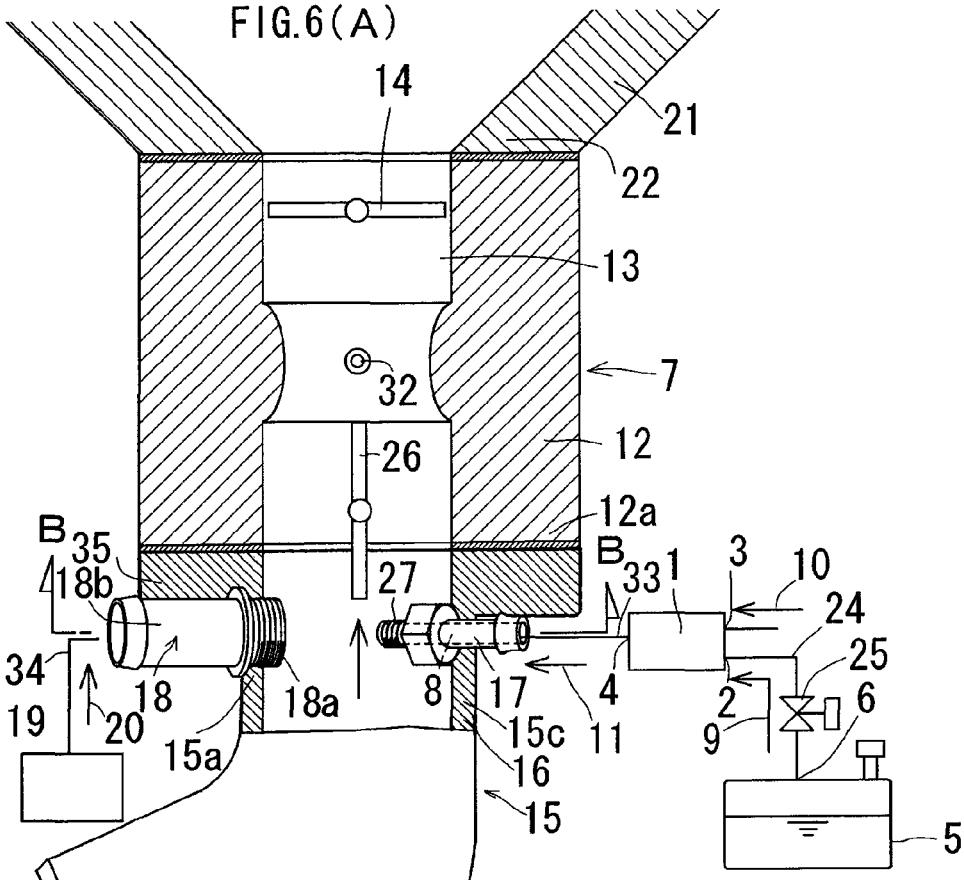
FIG. 6(A) is a plan view, in cross section, of an intake-air pipe and its peripheral parts
Figure 6B:
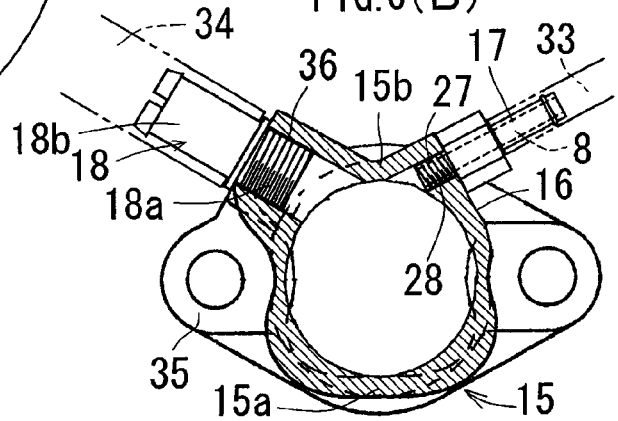
FIG. 6(B) is a sectional view taken along a line B-B in FIG. 6(A).
Figure 7A:
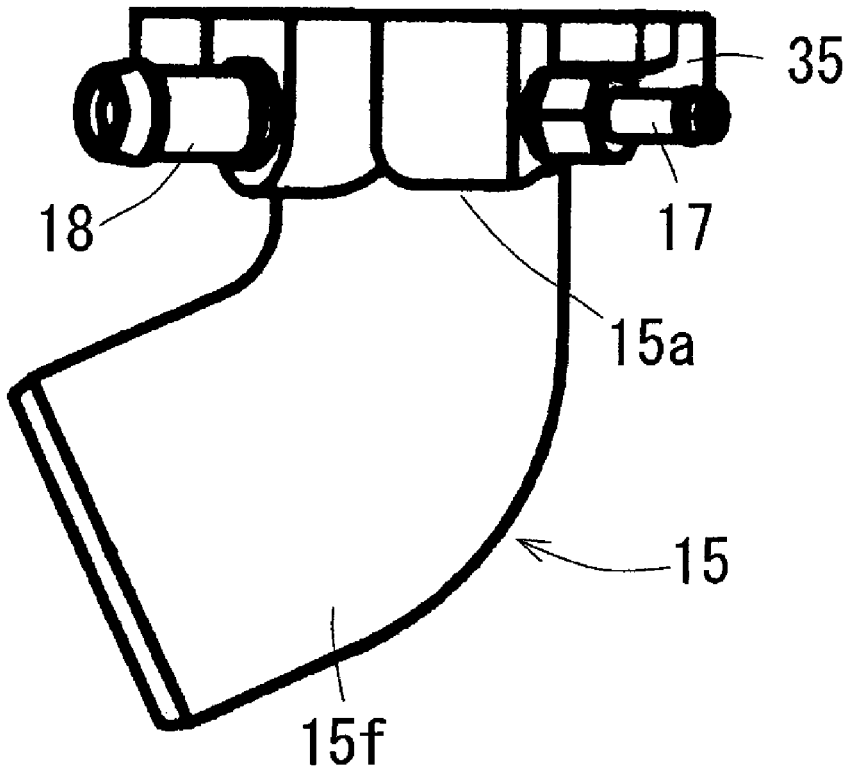
FIG. 7(A) is a plan view and FIG. 7(B) is a front view.
Figure 7B:
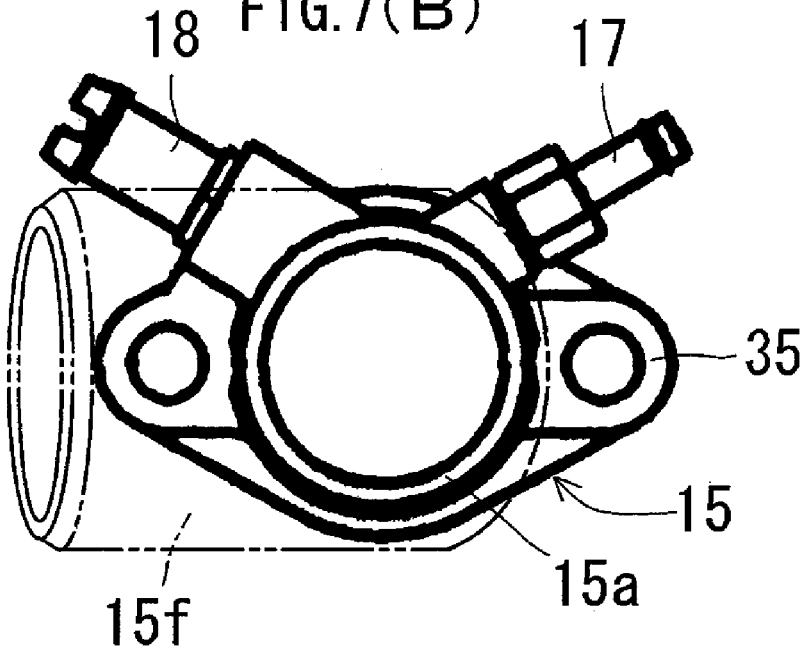

In the third embodiment as shown in FIGS. 6(A) and 6(B) as well as in FIGS. 7(A) and 7(B), the intake-air pipe 15 is a horizontally bent pipe which comprises a horizontal portion 15*a* extending straightly in the front and rear direction and a horizontally bent pipe portion 15*f*. The horizontal pipe portion 15*a* has a base end portion provided with a flange 35.

In either of the second embodiment and the third embodiment, the blow-by gas sucking pipe 18 is a straight pipe and has on its base end side a blow-by gas outlet passage 18*a* an outer periphery of which is provided with an externally threaded portion. The externally threaded portion is engaged with an internally threaded portion of an attaching hole 36 in screw-thread fitting relationship. The blow-by gas sucking pipe 18 has on its leading end side a blow-by gas inlet passage 18*b* inclined downwardly as well as the blow-by gas outlet passage 18*a* on the base end side.

The other construction and function are the same as those of the first embodiment. In FIGS. 4(A) and 4(B) to FIGS. 7(A) and 7(B), the elements identical to those of the first embodiment are designated by the identical reference numerals in FIGS. 1(A) and 1(B) as well as in FIGS. 2(A) and 2(B).

EXPLANATION OF REFERENCE NUMERALS (1) Canister
(2) Vaporized-fuel inlet
(3) Air inlet
(4) Purge-gas outlet
(5) Fuel reservoir
(6) Vaporized-fuel outlet
(7) Intake-air passage
(8) Purge-gas sucking port
(9) Vaporized-fuel
(10) Air
(11) Purge gas
(12) Throttle body
(12*a*) Intake-air inlet portion
(13) Throttle intake-air passage
(14) Throttle valve
(15) Intake-air pipe
(15*a*) Horizontal pipe portion
(15*b*) Upper peripheral wall
(15*c*) Intake-air outlet portion
(15*d*) Inner passage
(16) Peripheral wall
(17) Purge-gas sucking pipe
(18) Blow-by gas sucking pipe
(18*a*) Blow-by gas outlet passage
(19) Breather chamber
(20) Blow-by gas
(26) Choke valve

What is claimed is:

1. A vaporized-fuel processing device for an engine, comprising a canister (1) provided with a vaporized-fuel inlet (2) and with an air inlet (3) as well as with a purge-gas outlet (4), the vaporized-fuel inlet (2) being communicated with the vaporized-fuel outlet (6) of a fuel reservoir (5) and the air inlet (3) being communicated with the air, the purge-gas outlet (4) being also communicated with the purge-gas sucking port (8) of the intake-air passage (7), the vaporized fuel (9) within the fuel reservoir (5) being adsorbed to an adsorbing member of the canister (1), while the engine is in operation, the intake-air negative pressure produced in the intake-air passage (7) being made to suck the air (10) from the air inlet (3) into the canister (1), the air (10) separating the vaporized fuel (9) adsorbed to the adsorbing member of the canister (1), the purge gas (11) resulting from mixing the vaporized-fuel (9) into the air (10) being sucked from the purge-gas sucking port (8) into the intake-air passage (7), wherein a throttle body (12) is arranged in the intake-air passage (7) and has a throttle passage (13), which is provided with a throttle valve (14), an intake-air pipe (15) is arranged intake-upstream of the throttle body (12) and is communicated with the throttle intake-air passage (13), the intake-air pipe (15) having a peripheral wall (16) to which a purge-gas sucking pipe (17) is detachably attached, the purge-gas sucking port (8) being provided within the purge-gas sucking pipe (17), during the engine's operation, in order for the intake-air negative pressure produced in the intake-air passage (7) to suck blow-by gas (20) from a breather chamber (19) to the intake-air pipe (15), a blow-by gas sucking pipe (18) is communicated with the breather chamber (19), the intake-air pipe (15) has a horizontal pipe portion (15*a*) to an upper peripheral wall (15*b*) of which the purge-gas sucking pipe (17) is attached diagonally downwardly, the intake-air pipe (15) has the horizontal pipe portion (15*a*) to the upper peripheral wall (15*b*) of which the blow-by gas sucking pipe (18) has a blow-b gas outlet passage (18*a*) attached diagonally downwardly, the blow-by gas sucking pipe (18) and the purge gas sucking pipe (17) are arranged dividedly in the left and right direction and the blow-by gas outlet passage (18*a*) of the blow-by gas sucking pipe (18) and the purge-gas sucking pipe (17) are inclined downwardly in the direction that brings them toward each other, and the purge-gas sucking pipe (17) is arranged so that it is positioned away from an intake-downstream side of the blow-by gas sucking pipe (18).

2. The vaporized-fuel processing device for an engine as set forth in claim 1, wherein a choke valve (26) is arranged upstream of the throttle valve (14) in the throttle intake-air passage of the throttle body (12).

3. The vaporized-fuel processing device for an engine as set forth in claim 1, wherein the throttle body (12) has an intake-air inlet portion (12*a*) connected to an intake-air outlet portion (15*c*) of the intake-air pipe (15), to which the purge-gas sucking pipe (17) is attached.

4. The vaporized-fuel processing device for an engine as set forth in claim 3, wherein the intake-air pipe (15) has the intake-air outlet portion (15*c*), which is formed from a pipe portion of an inner diameter unvariable.

* * * * *